United States Patent [19]

Kaino

[11] Patent Number: 4,523,913

[45] Date of Patent: Jun. 18, 1985

[54] BUOYANT EMERGENCY LIFE SAVING DEVICE

[76] Inventor: Jon C. Kaino, P.O. Box 857, Ilwaco, Wash. 98624

[21] Appl. No.: 545,152

[22] Filed: Oct. 25, 1983

Related U.S. Application Data

[63] Continuation-in-part of Ser. No. 393,456, Jun. 29, 1982, abandoned.

[51] Int. Cl.[3] ..... B63C 9/10; B63C 9/20

[52] U.S. Cl. ..... 441/81; 441/84; 441/89

[58] Field of Search ..... 441/17, 20, 36, 80, 441/81, 84, 88, 89

[56] References Cited

U.S. PATENT DOCUMENTS

| | | | |
|---|---|---|---|
| 988,830 | 4/1911 | Smith | 441/89 |
| 2,109,813 | 3/1938 | Winckler | 441/81 |
| 2,366,303 | 1/1945 | White | 441/81 |
| 3,095,586 | 7/1963 | Baier | 441/81 |
| 3,445,869 | 5/1969 | Tyrer | 441/81 |
| 4,033,002 | 7/1977 | Higgs | 441/80 |
| 4,195,380 | 4/1980 | Higgs | 441/17 |

*Primary Examiner*—Sherman D. Basinger
*Attorney, Agent, or Firm*—Cole, Jensen & Puntigam

[57] ABSTRACT

A safety flotation device comprising an emergency rescue and life saving buoy for boats which is formed of a flotation body having a ring-type, hollow plastic body generally filled with lightweight plastic foam and which also includes compartments for tethering lines, flares, beacon light and the like. The device is also provided with hand grips and hand grip ropes around the sides of the flotation body. All lines are secured to the body and tether lines include hooks or clips. The compartment for flares is covered.

8 Claims, 12 Drawing Figures

FIG. 4
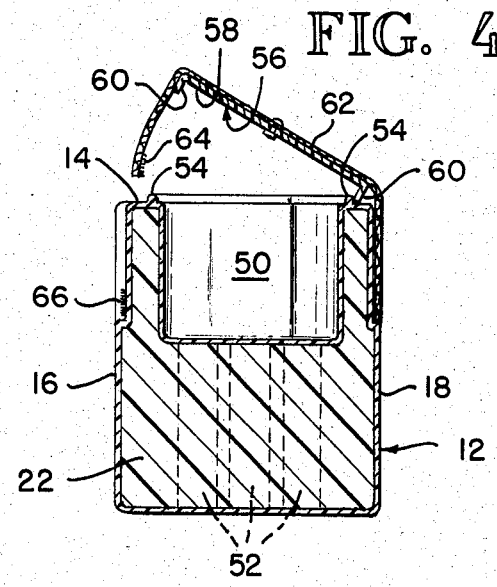
FIG. 3
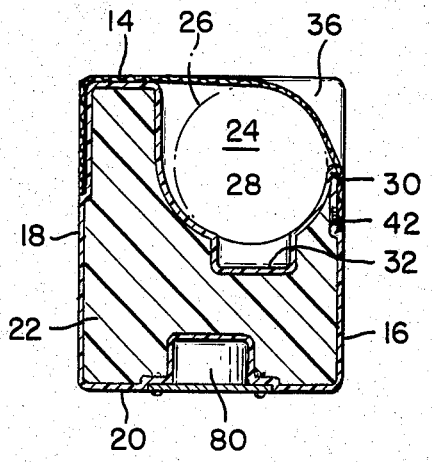
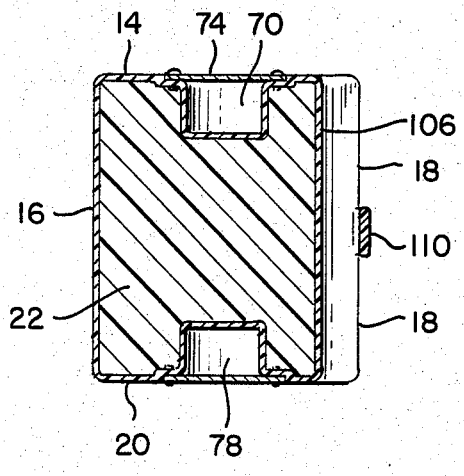
FIG. 5
FIG. 6
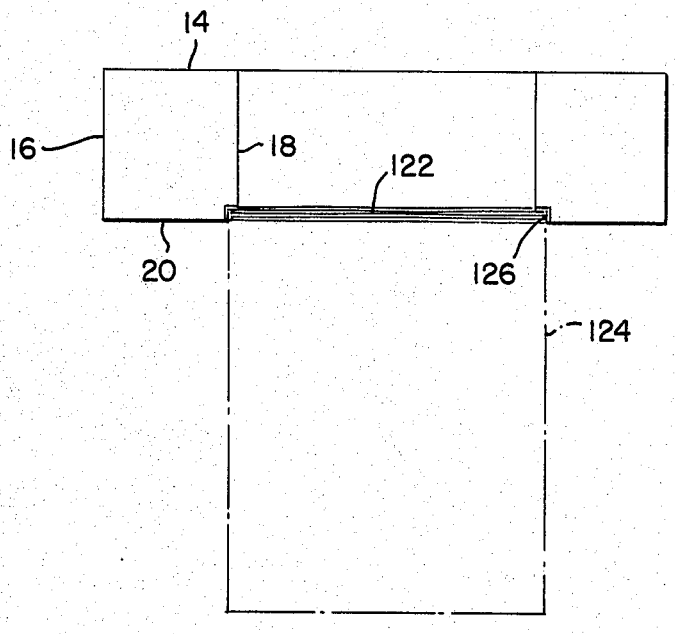

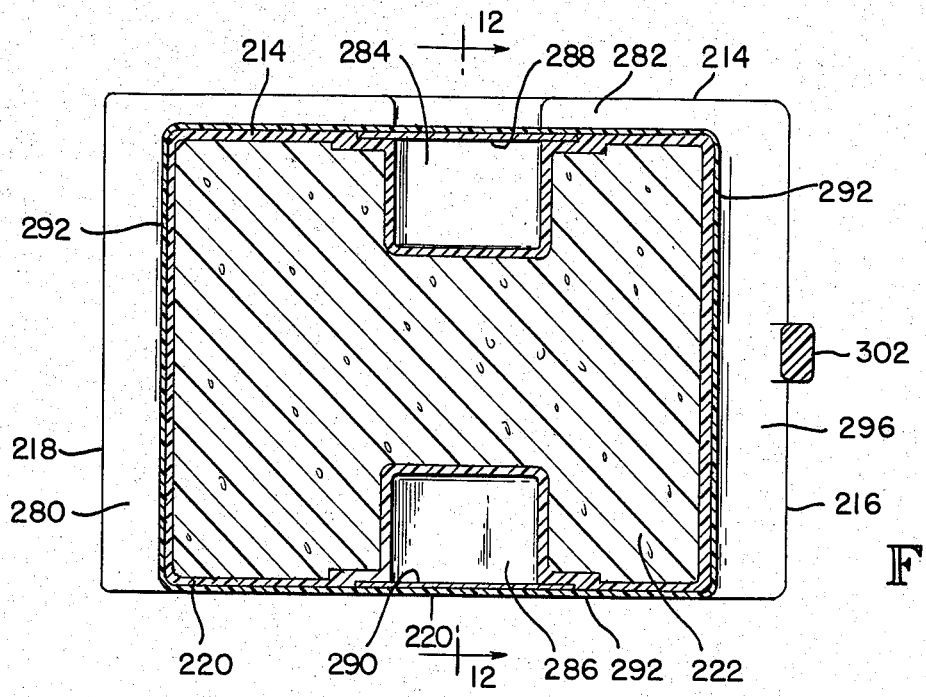
FIG. 10
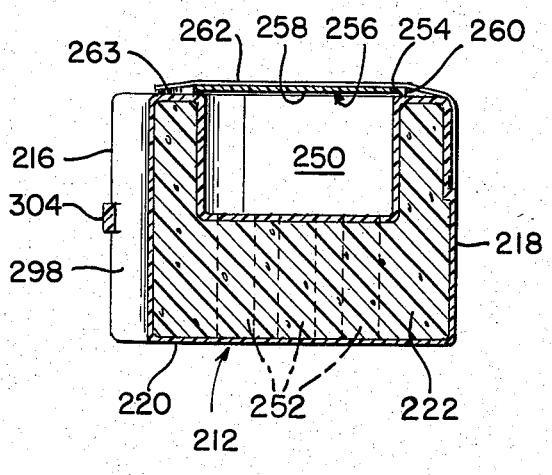
FIG. 11
FIG. 12
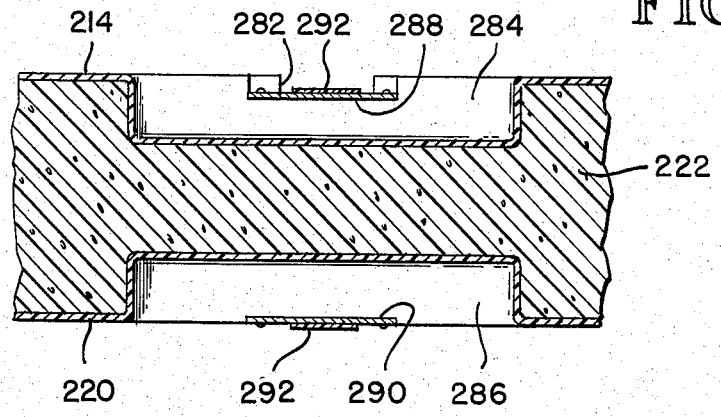

BUOYANT EMERGENCY LIFE SAVING DEVICE

This application is a continuation-in-part of my copending United States Patent Application Ser. No. 393,456, filed June 29, 1982 in the name of applicant herein now abandoned.

BACKGROUND OF THE INVENTION

This invention relates to life saving gear for boats and more particularly to an emergency rescue buoy device flotation device which is equipped with life saving and signalling equipment.

In the last two decades, people have taken to waters for recreation by the hundreds of thousands. Most of the watercraft owned or used by these recreationists range from about 18' to 30' in length and operate in the same waters that were once used exclusively by much larger vessels.

The safety equipment for these smaller boats has been substantially ignored. At present, standard safety equipment consists of Coast Guard required signal devices such as air horns and flares and safety items such as life jackets. Larger vessels carry survival suits and inflatable rafts. These items are impractical for the small boat owner because of the space required, the weight added, and/or the extremely high costs involved.

The two primary concerns to the small boater when he has to abandon his vessel are first that the persons on board when they go into the water stay together as a group and, second, that they be able to draw attention to themselves so that they can be rescued. Staying together has been proven to be one of the key factors to survival in time or times of crisis. The most important time to have signaling devices available is when a person is in the water. In too many cases, in small boat accidents, rescue, life saving or signaling devices go down with the boat.

Most known rescue buoys are designed to mark the location of a sunken vessel. For that reason, they are usually complicated, large and heavy and thus unsuitable or too expensive for use on small craft. Other rescue buoys feature beacon or locator radio signals. These do not offer enough protection since only Coast Guard vessels and a few other craft would be equipped to pick up the signals. Since small vessels are usually near land or other vessels, it is preferable to have flare guns, smoke flares or the like to attract attention. This is so because most people in distress are rescued by other boats in the area and not the Coast Guard.

Among the prior art patents which were considered with respect to this invention were U.S. Pat. Nos. 1,206,713; 1,273,522; 1,372,591; 2,366,303; 3,095,586; 3,181,135; 3,618,150; 4,033,002; 4,195,380; and 4,228,556. Foreign patents are Canadian Patent No. 849,286; British Patent Specification No. 1,559,901 and French Patent No. 1,455,619. None of the referenced patents, either domestic or foreign, was found to be particularly pertinent to the details of this invention.

SUMMARY OF THE INVENTION

The emergency rescue buoy and flotation device of this invention is a generally ring-shaped hollow, hard plastic shell or body filled with a lightweight, low density plastic foam material. The body is configured to provide tether line compartments in which the tethers are stored and line or rope tie bars to which tether lines, hand grip ropes, pointers and any other line may be secured. On the end of the tether line is an appropriate hook or clip mechanism which can be attached to a life vest or the like. The compartments are designed so that the tether lines can be pulled out if and as needed and easily replaced. The flotation body is provided with tie bars which can also function as hand grips. The flotation body shell is water tight and filled with buoyant lightweight foam. A storage compartment is recessed into the flotation body and contains storage space for items such as flares, flare gun, radio transmitter if included as part of the equipment and other signal and survival items which may be of use in an emergency situation. The device includes strips of reflective tape and partial covers or retainers over the tops of tether line compartments.

Accordingly, it is among the features and advantages of the invention to provide an emergency rescue buoy which is adapted specifically for use by the owners and operators of small watercraft and which is relatively inexpensive and thus within the affordable range by the small boat owner or operator. It is an invention which is needed. The device can be stored loosely within or hung loosely within a small vessel so that it would float free in the event the craft sinks. It is designed to store a limited supply of such items as flares, tackle, hooks and other fishing gear, emergency food, radio beacon and other equipment. It is further a purpose to provide a safety device that will give maximum protection at low cost and occupy very little space on the craft. The invention is designed to go into the water with people and keep the survivors together since scattering and separation are important factors in the loss of lives. It also contains signalling items for the survivors. The compactness of the invention is such that it can be stored in the cabin and taken out on each trip. It can be used as a life ring for somebody who falls overboard though its basic function is greater in scope. The outside of the device is Coast Guard orange and provided with patches or strips of reflective tape which makes it highly visible. All equipment within storage areas is strapped or otherwise secured so that such equipment is not lost if the device is tipped over. The device is not intended as a life ring as such since its function is to provide a flotation apparatus to which people in preservers and jackets may attach and to which life boats or rafts may be secured.

BRIEF DESCRIPTION OF THE DRAWINGS

FIG. 3 is a vertical cross-section view taken along the line 3—3 of FIG. 2 showing additional details of construction;

FIG. 4 is a vertical cross-section view taken through the flotation device along the line 4—4 of FIG. 2;

FIG. 5 is a vertical cross-section view taken along the line 5—5 of FIG. 2 showing additional details of construction;

FIG. 6 is a diagrammatic cross-section view of the device of FIG. 2 showing that a protective bag may be attached to the lower inside surface of the device;

FIG. 10 is another cross-section view of the flotation device of FIG. 7 taken along the line 7—7 and showing more details of construction;

FIG. 11 is another cross-section view taken along the line 11—11 of FIG. 7; and

FIG. 12 is a partial vertical cross-section view taken along the line 12—12 of FIG. 7 to show details of construction.

DESCRIPTION OF PREFERRED EMBODIMENTS

Figure 1:
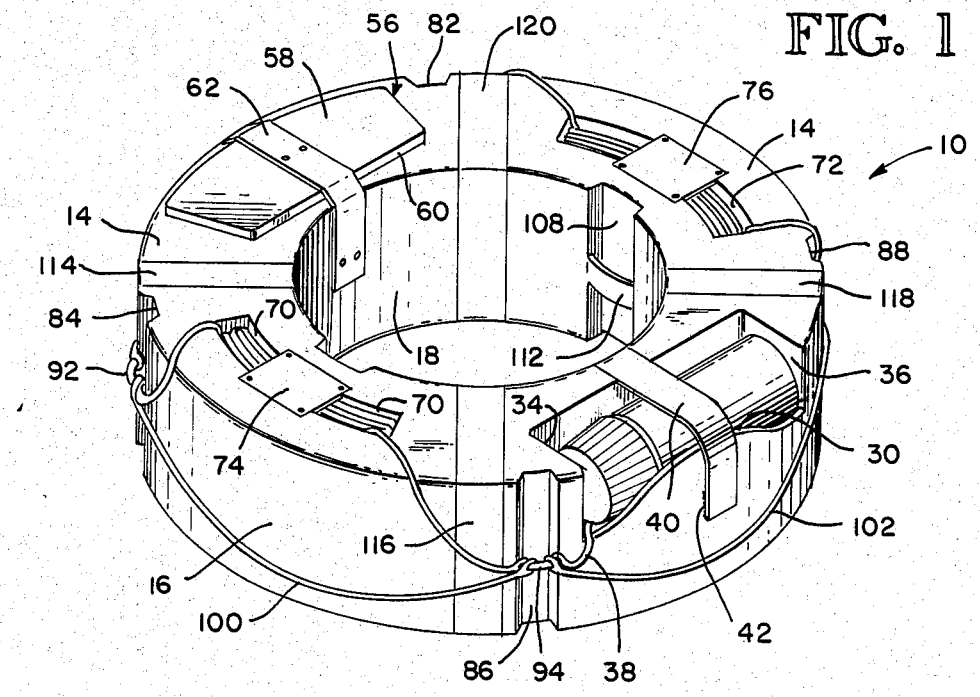
FIG. 1 is a perspective view of one embodiment of the invention showing generally its configuration and structure.
Figure 2:
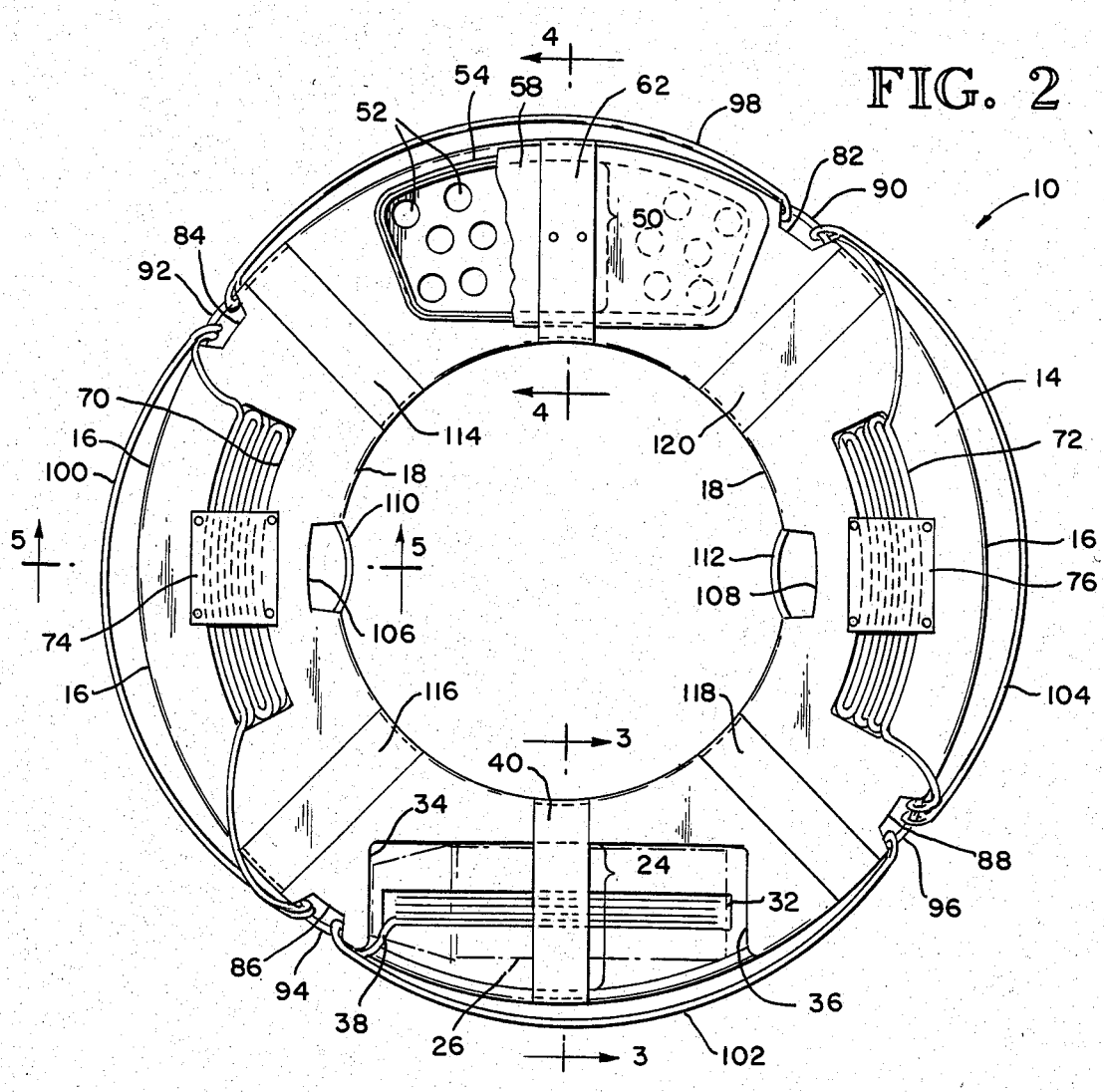
FIG. 2 is a top plan view of a larger diameter embodiment of the invention showing details of construction thereof.

It will be seen by reference to FIGS. 1–6 that the invention, generally identified by the number 10, is in the shape of an annulus having a generally rectangular cross-section. The invention includes a hard, plastic, hollow body or shell 12 having a top surface 14, an outside surface 16, an inside surface 18 and a bottom surface 20, the shell being approximately ⅛" thick, dense or rigid plastic material. While the cross-sectional configuration is shown to be generally rectangular, it is understood that the precise cross-sectional shape is or may be a matter of production costs mold limitations or other factors. The body shown in FIG. 2 is suitable to an approximately 30" outside diameter annulus with an approximately 16" inside diameter. The body is preferably filled with rigid, low density, lightweight plastic foam material 22.

The embodiments of this invention is as can be appreciated by reference to the dra wings are not life preservers. The buoyant apparatus 10 of this invention is intended for multi-survivor use in which the apparatus accompanies the survivors into the water as an additional safety device. Persons in the water in survival suits, on life preservers or in rafts may tether to the apparatus and have at their disposal flares and other signaling and survival gear. Accordingly, the invention 10 has a number of specific features in addition to its buoyancy capability which make it valuable as a safety device.

In one quadrant of the upper surface is located an open compartment 24 which accommodates an approximately 4" diameter strobe-type light housing 26 shown in phantom lines in FIG. 3. The strobe light housing 26 is strapped into the compartment 24 which is shown to have a generally rounded bottom surface 28 and a retaining lip 30 which is formed in conjunction with outside body wall 16. A strap holds the light in compartment 24 and which strap can be quickly released if the device 10 is in the water. Beneath the light and on the bottom of compartment 24 and formed in conjunction with compartment wall 28 is an elongated rectangular tether line pocket 32 which accommodates a tether line, not shown, which is attached to the light housing 26. Compartment 24 is approximately 14 inches long having end walls 34 and 36. The tethering line compartment 32 is approximately 1" deep by 1" in width, though those dimensions may vary and it extends the length of the compartment 24. A tether line 38 as stated above is folded into pocket 32 and has one end attached to the light housing 26 while the other end is secured to the flotation device. The strobe light housing when in the waterwill float generally vertically but will be secured to the flotation device by the tether line 38. The light cannister or housing 26 is held in the compartment until needed for use by a strap 40 which preferably is riveted on the inside surface 18 of the flotation device and loops over and secures on the front or outside surface 16 by a velcro or some other mechanical strap attachment means 42. The other end of the strap, attached to inside surface 18 may if desired be attached by rivets or other dependable anchoring means.

Diametrically opposed and opening on the upper surface 14 of flotation device 10 is a covered storage compartment 50 which is recessed downwardly a little bit less than half the distance into the flotation foam 22. The primary use for the compartment 50 is to store flare devices in holes 52 though other items of signal and survival assistance, such as food, beacon transmitter or the like may be stored. A ridge or brow 54 can be seen to extend around the compartment 50 opening to assist in excluding water from entering compartment 50. A lid or cover 56 having cover portion 58 and a depending lip 60 around the entire periphery of cover portion 58 is dimensioned so that lip 60 when the cover is in position engage top surface 14 outside the ridge or brow 54. The cover 56 is attached to flexible strap 62 by means such as rivets and the strap is also attached to the inside surface 18 as by rivets or the like. The other end of the strap includes a velcro or other mechanical means of attaching the free end of the strap 64 to the coacting member 66 as best seen in FIG. 4.

Between the strobe light compartment and the flare compartment are tethering line pockets 70 and 72 which for purposes of illustration in a full scale flotation device will be approximately 2" wide by 1" deep by about 14" long. Each of the compartments 70 and 72 will hold two tethering lines of approximately 6–10 feet in length with clasps or clips or hooks on the end thereof for attachment to rafts, life preservers, jackets or survival suits. Over each of the compartments or pockets 70 and 72 are partialplastic covers 74 and 76 which are secured to the top surface 14 of the flotation device but which cover only enough of the pocket or compartment to hold the tether ropes in place. As can be seen in FIG. 5, the underside of the flotation device also contains tether rope pockets beneath those on top in addition to a third pocket or compartment 80 beneath the strobe light compartment 24. Thus, there are five tethering line pockets or compartments between the top and bottom surface of the flotation device.

At approximately 90 degree intervals are vertically extending recesses 82, 84, 86 and 88 in the outer side wall 16. Approximately midway down the depth of the recesses are rope or line tie downs 90, 92, 94 and 96 to which the tether lines are secured and to one of which the tether eline for the strobe light cannister 26 also attaches. Hand grip ropes 98, 100, 102 and 104 are also secured to these tie downs. The rope tie down bars may be dimensioned so that they also act as hand grips if desired.

On the inside surface of the flotation device are vertical recesses 106 and 108 which are also provided with gripping bars 110 and 112. Spaced at 90 degree intervals are reflective tape means 114, 116, 118 and 120 which reflective tape extends entirely around the body. The tapes are recessed about ⅛" and are approximately 2" in width.

FIG. 6 is a diagrammatic view of the device taken along a diameter line to show that a plastic material may be folded up as at 122 when the device is not being used and which when put in the water may provide additional survival capacity by folding out into a pocket such as 124. The connection of the plastic fold-out would be made weather proof around the annular recess 126.

Figure 7:
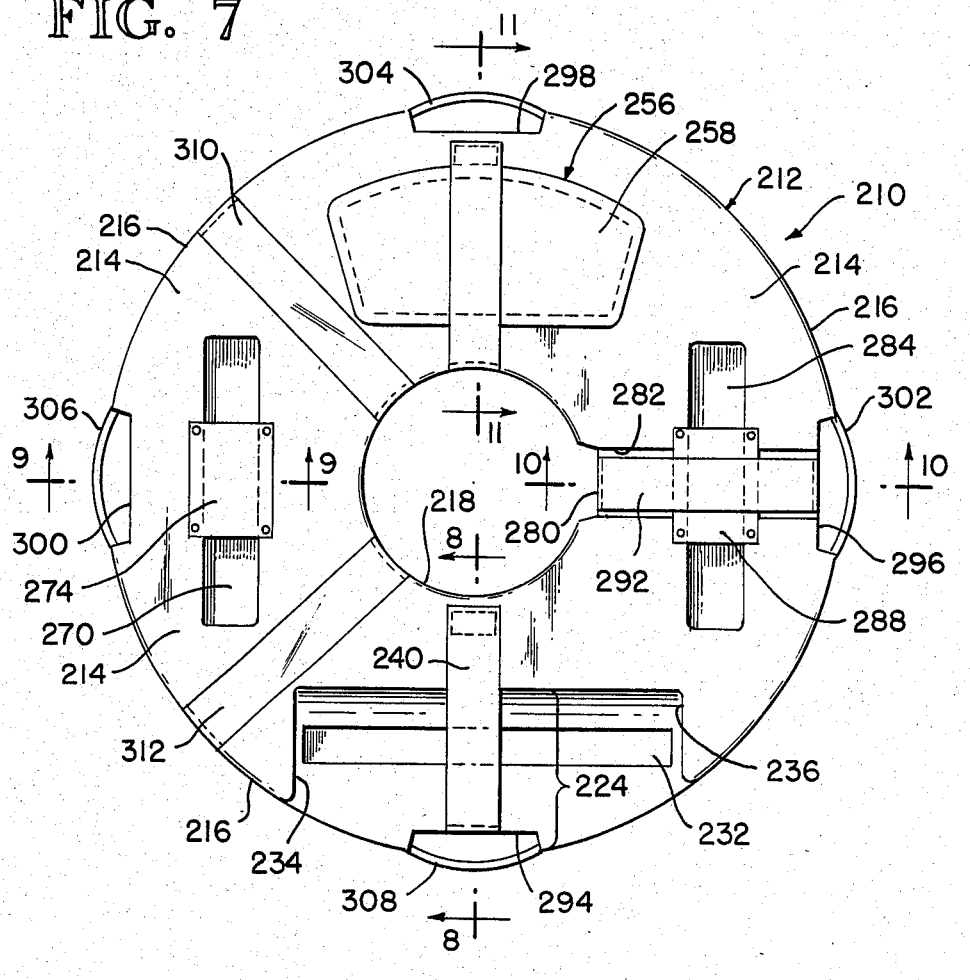
FIG. 7 is a top plan view of a smaller diameter embodiment of the invention which includes many of the features of the larger embodiment.
Figure 8:
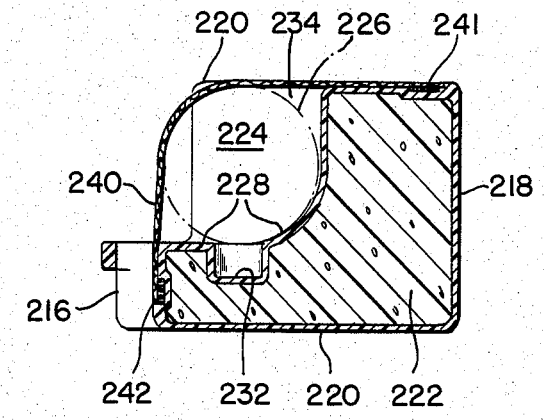
FIG. 8 is a vertical cross-section view taken along the line 8—8 of FIG. 7 showing details of construction.

FIGS. 7–12 show a slightly smaller version of the embodiment just described in that the hard plastic shell hollow body is 26" in outer diameter with an 8" opening. The annulus measures 9" from outer diameter to inner diameter and is 6½" or 7" deep. Again, the device 210 with shell 212 is filled with low density, lightweight rigid plastic foam material 222. FIGS. 7 and 8 show a light compartment which is approximately 14" long and which accommodates a 4" diameter strobe light housing shown in phantom lines 226. The compartment 224 is defined by the wall structure 228 and end walls 234 and 236. In the bottom of the compartment is a tethering rope pocket for the strobe light housing and the other end of which is attached to one of the outside diameter hand grips or rope tie bars. A strap 240 is secured at one end as at 241 by rivets or other firmly securing means and at the detachable end may be secured by snaps or as in the instance shown by velcro fastener means on the end of the strap and attached to the housing.

FIGS. 7 and 11 show details of the covered storage compartment 250 which is primarily for flares as indicated by holes 252 extending down through the plastic foam to the inside surface of the outer shell 212. A ridge or raised portion 254 extends around the entire periphery of the opening into compartment 250. Cover 256 having the cover portion 258 and the depending edge or lip 260 is provided and is attached to strap 262 which may be secured at one end as by rivets and secured by detachable means such as a velcro connector 263 or other desired means for holding cover 256 firmly in place.

Figure 9:
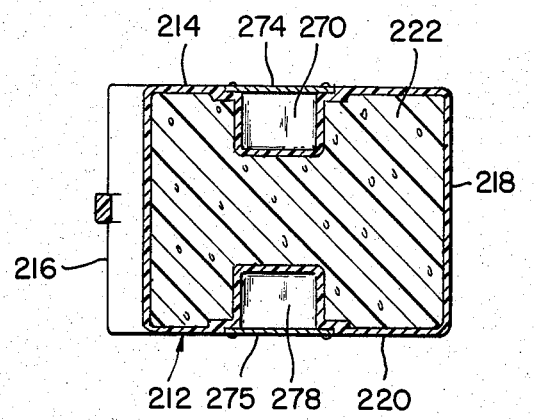
FIG. 9 is a vertical cross-section view taken along the line 9—9 of FIG. 7 and showing additional details.

FIGS. 7 and 9 show top and bottom surface tethering line or compartments 270 on the top surface and 278 on the bottom surface. The compartments being partially covered by cover 274 on the top and cover 275 on the bottom.

FIGS. 7 and 10 show in detail the features of construction in that quadrant of the device by which the flotation apparatus may be hung on a bulkhead of a smaller boat if desired. It will be noted that on the inside diameter a recess 280 is provided which is approximately ¾" deep and roughly 2½" in width. Recess 280 extends from the bottom wall 220 to the top wall 214. Additionally, a slightly shallower recess 282 is provided along the top of the flotation apparatus which recess extends from the inside diameter to the outside diameter. Tethering rope compartments or pockets 284 on top and 286 on the bottom surface are provided along with their covers 288 and 290. It will be seen that the covers 288 and 290 are recessed to a depth of their thickness. Reflective tape 292 extends around the entire periphery of the body as best seen in FIG. 10.

Outside surface 216 has indentations or recess 294, 296, 298, and 300 which are spaced at 90 degree intervals and each is provided with a rope tie down 302, 304, 306 and 308. Strips of reflective tape 310 and 312 are provided and are recessed approximately ⅛" around the entire circumference of the body.

It will be appreciated that precise dimensions of the features of the invention are subject to design variation. The invention, however, is intended to be hung on a 2" metal bracket which extends out from a bulkhead on which the inside recess 280 can be accommodated with an upturned end to be received in the groove or recess 282 on the top surface 10.

I claim:

1. Life saving and emergency rescue flotation device to be carried on small vessels, comprising:

(a) an annulus type flotation body having a hollow, hard plastic, shell body with flotation means therein, said flotation body being rectangular in its cross-section and having top and bottom walls and inner and outer side walls, said flotation means consisting of low density, lightweight, buoyant plastic foam material, (b) said flotation body including on its top surface a generally upwardly opening and uncovered first compartment for containing a removable emergency tethered light means and further including retaining means for holding said light means in said first compartment, (c) said flotation body further including an open, second compartment for containing survival and emergency signalling gear and the like and which second compartment has removable cover means therefor, (d) at least one tethering line compartment formed in each of the top and bottom walls and having tethering lines therein secured by at least partial retaining cover means over said tethering line compartments, (e) at least two rope tie down means on the outer side wall of said flotation body for gripping if desired and for securing tethering lines and a line for said light means, and (f) hand grip rope means secured between said rope tie down means.

2. The life saving and emergency rescue flotation device of claim 1 and in which a pocket is located at the bottom of said first compartment for containing a rope line which is received at one end to said light means and at the other end to one of said rope tie down means.

3. The life saving and emergency rescue flotation device of claim 1 and in which rope tie down means are provided on the inner side wall of said device.

4. The life saving and emergency rescue flotation device according to claim 1 and in which said device includes strips of light reflective tape extending around substantially the entire periphery of said device at predetermined locations thereon.

5. The life saving and emergency rescue flotation device according to claim 1 and wherein said first and second compartments open generally upwardly on said device.

6. The life saving and emergency rescue flotation device according to claim 1 and wherein said outer side wall includes four, equi-spaced rope tie down and hand gripping means located approximately mid-way between said top and bottom walls and including recess portions inboard of each of said rope tie down means.

7. The life saving and emergency rescue flotation device according to claim 6 and wherein said four hand grip rope means are provided around the outer side wall and attached to said rope tie down means.

8. The life saving and emergency rescue flotation device according to claim 1 and in which at least two of said tethering line compartments are provided in each of said top and bottom surfaces.

* * * * *